166-273 SR

8/4/87 XR 4,683,948

United States Patent [19]

Fleming

[11] Patent Number: 4,683,948

[45] Date of Patent: Aug. 4, 1987

[54] ENHANCED OIL RECOVERY PROCESS EMPLOYING CARBON DIOXIDE

[75] Inventor: Graham C. Fleming, Plano, Tex.

[73] Assignee: Atlantic Richfield Company, Los Angeles, Calif.

[21] Appl. No.: 866,542

[22] Filed: May 23, 1986

[51] Int. Cl.[4] ..... E21B 43/22

[52] U.S. Cl. ..... 166/263; 166/268; 166/273

[58] Field of Search ..... 166/263, 268, 273, 274

[56] References Cited

U.S. PATENT DOCUMENTS

| | | | |
|---|---|---|---|
| 3,065,790 | 11/1962 | Holm | 166/274 |
| 3,123,134 | 3/1964 | Kyte et al. | 166/263 |
| 3,207,217 | 9/1965 | Woertz | 166/273 |
| 3,330,342 | 7/1967 | Holm | 166/263 |
| 3,525,395 | 8/1970 | Chew | 166/263 |
| 3,525,396 | 8/1970 | Chew | 166/263 |
| 3,811,503 | 5/1974 | Burnett et al. | 166/273 X |
| 4,224,992 | 9/1980 | Comberiati et al. | 166/273 |
| 4,509,596 | 4/1985 | Emery | 166/263 |
| 4,529,037 | 7/1985 | Froning et al. | 166/268 X |

*Primary Examiner*—George A. Suchfield

*Attorney, Agent, or Firm*—Michael E. Martin; Frank J. Uxa

[57] ABSTRACT

A process for recovering hydrocarbons, e.g., crude petroleum, from a formation comprising: (a) injecting carbon dioxide into the formation; (b) shutting off the wells to the formation to allow the carbon dioxide to contact and disperse in the hydrocarbons in the formation; (c) recovering hydrocarbons from the formation; (d) repeating steps (a), (b) and (c) at least once; (e) injecting a carbonated aqueous liquid composition into the formation to drive the hydrocarbons toward the production well or wells and (f) recovering hydrocarbons from the formation.

20 Claims, No Drawings

ENHANCED OIL RECOVERY PROCESS EMPLOYING CARBON DIOXIDE

This invention relates to recovering hydrocarbons from a porous formation. More particularly, the invention relates to a process for recovering hydrocarbons, e.g., crude petroleum, from a porous formation which involves injecting carbon dioxide into the formation.

Carbon dioxide is known to dissolve readily in crude petroleum. With added carbon dioxide in solution, the viscosity of crude petroleum is substantially reduced. The use of carbon dioxide as a miscible agent has been suggested in a variety of enhanced oil recovery (EOR) processes. For example, it has been proposed to inject carbon dioxide into an oil-bearing formation to reduce the oil's viscosity and increase the oil production rate. Cyclic carbon dioxide injection has been suggested. In this configuration, carbon dioxide is injected into the oil-bearing formation for a period of time and then oil is recovered for a period of time. This cycle is repeated to provide for oil recovery.

Various means of transporting carbon dioxide throughout the oil-bearing formation have been suggested. For example, carbonated water has been suggested as both the carbon dioxide source and the means of transporting carbon dioxide throughout the oil-bearing formation.

U.S. Pat. No. 3,330,342 discloses a secondary oil recovery process in which a slug of hydrocarbon and a slug of carbon dioxide or a slug of carbon dioxide alone is injected into a partially depleted reservoir to establish a reservoir pressure of at least 700 psi. Thereafter, an aqueous medium, e.g., carbonated water, is injected into the reservoir to cause the hydrocarbon and carbon dioxide or carbon dioxide alone to contact the oil in the reservoir and pass through the reservoir while a pressure in excess of 700 psi. is maintained in the reservoir.

The following additional U.S. patents have been reviewed in preparing this application: U.S. Pat. Nos. 3,126,951; 3,157,230; 3,354,953; 3,465,823; 4,558,740; and 4,467,868. There continues to be a need for EOR processes which take advantage of the useful properties of carbon dioxide.

Therefore, one object of the present invention is to provide a process for recovering hydrocarbons from a hydrocarbon-bearing formation.

Another object of the invention is to provide a process for recovering crude petroleum from a crude petroleum-bearing formation.

A further object of the invention is to provide a hydrocarbon recovery process employing carbon dioxide. Other objects and advantages of the present invention will become apparent hereinafter.

A process for recovering hydrocarbons from a hydrocarbon-bearing formation through at least one production well in fluid communication with the formation has been discovered. In one broad aspect, the process comprises: (a) injecting carbon dioxide into the formation; (b) shutting in the formation for a period of time sufficient to allow at least a portion of the injected carbon dioxide to contact and become dispersed in the hydrocarbons in the formation; (c) recovering hydrocarbons from the formation; (d) repeating steps (a), (b) and (c) at least once; (e) injecting an at least partially carbonated aqueous liquid composition into the formation through at least one injection well in fluid communication with the formation in an amount effective to drive the hydrocarbons in the formation toward the production well; and (f) recovering hydrocarbons from the formation through the production well. In one alternate embodiment step (a) is repeated after step (d) and before step (e). In any event, it is preferred to maintain a back pressure on the production means until the void space created in the formation during steps (d) and (a) is substantially occupied by the aqueous liquid composition injected in step (e). The back pressure is maintained at a sufficient level so that the average pressure in the formation is not substantially reduced, more preferably not reduced by more than about 50 psi, relative to the average formation pressure prior to conducting step (a) for the first time. In certain instances, substantially no hydrocarbon is recovered from the production means during this point of time. The present process is particularly useful in recovering crude petroleum and the like substantially hydrocarbonaceous materials. Excellent results are obtained in recovering heavy or viscous petroleum crude oils. Included among these heavy or viscous oils are materials which are substantially more effectively recovered by reducing the viscosity of the materials in situ in the formation.

The repeated or cyclic injections of carbon dioxide into the formation preferably acts to facilitate effective contacting of carbon dioxide with the hydrocarbons in at least a portion of the formation, more preferably throughout at least a substantial or major portion of the formation. The cyclic injections of carbon dioxide into the formation act to precondition the hydrocarbons, e.g., crude petroleum oil, into which carbon dioxide is dispersed by reducing the viscosity of such hydrocarbons prior to injecting the at least partially carbonated aqueous liquid composition into the formation. The present process is substantially unaffected by gravity override or formation (reservoir) layering, which results in poor contact efficiency in many EOR processes employing gases. This process may provide considerable incremental crude oil recovery relative to conventional waterflooding.

As noted above, the repeated or cyclic carbon dioxide injections preferably act to facilitate effective contacting between the carbon dioxide and the hydrocarbons in the formation. In order to improve this contacting, it is more preferred that all wells, in fluid communication with the formation be used to inject carbon dioxide into the formation during step (a). The number of cycles, i.e., the number of times steps (a), (b) and (c) are repeated may vary widely depending, for example, on the conditions present in the formation, the properties of the hydrocarbons to be recovered, the amounts and quality of the materials to be injected into the formation and the like. The number of times steps (a), (b) and (c) are repeated is preferably in the range of 1 to about 6 times, more preferably about 2 to about 4 times. Preferably substantially no hydrocarbons are recovered from the formation during steps (a) and (b).

The amount of carbon dioxide injected into the formation during each time step (a) occurs may vary widely and depends on the specific application involved. Preferably, the amount of carbon dioxide injected during each time step (a) occurs is in the range of about 0.1% to about 5% of the pore volume of the formation being treated, calculated at the conditions of temperature and pressure existing in the formation. This amount of carbon dioxide should be sufficient to fully saturate about 1% to 30% of the hydrocarbons in the formation with dissolved carbon dioxide. The carbon dioxide-containing material injected in step (a) may contain other constituents, but preferably comprises at least about 85 mole % of carbon dioxide.

In one embodiment of the present invention, step (a) involves injecting carbon dioxide and low molecular weight hydrocarbons into the formation. The low molecular weight hydrocarbons injected into the formation, in accordance with this invention, may be any low molecular weight hydrocarbon or hydrocarbon mixture which can be maintained in the liquid state at formation temperature and pressure, at the time the reservoir is being produced, and with which carbon dioxide is substantially completely miscible. Non-limiting examples of suitable hydrocarbons include propane, "LPG", compressor condensate, butane, gasoline, natural gasoline and all hydrocarbon fractions having a boiling point equal to or lower than that of kerosine. "LPG" is recognized in the petroleum industry as a term representing certain liquified petroleum gases being petroleum fractions lighter than gasoline, such as butane, propane, etc. and mixtures thereof which remain in the liquid state when maintained under pressure. As used herein and in the petroleum industry, "compressor condensate" refers to the liquid fraction obtained as a result of compressing natural gas for pipe line transmission. These condensates are rich in butane and pentane but contain minor amounts of propane and lighter hydrocarbons and of hexane and heavier hydrocarbons.

In step (b) of the present process, the formation is shut in for a period of time sufficient to allow at least a portion, preferably at least a major portion, of the injected carbon-dioxide to contact and become dispersed in the hydrocarbons in the formation. By "shutting in the formation" is meant that substantially no hydrocarbon or carbon dioxide leaves the formation through the wells, e.g., production wells and injection wells, in fluid communication with the formation. The amount of time during which step (b) occurs may range widely and be dependent on many variables. Step (b) should be long enough to provide for the requisite contacting and dispersing. Long shut in times are to be avoided in view of process efficiency considerations. The amount of time during which step (b) occurs may vary each time step (b) is repeated. The amount of time during which step (b) occurs preferably is in the range of about 6 hours to about 1 month, more preferably about 12 hours to about 2 weeks.

Step (c) involves recovering hydrocarbons from the formation. Relatively easily recovered hydrocarbons are recovered during this step. This hydrocarbon recovery provides a certain amount of void space in the reservoir which, in turn, allows more effective carbon dioxide contacting and dispersing if steps (a) and (b) are to be repeated or facilitates the effectiveness of the drive fluid is step (e) is to be carried out. In addition, valuable hydrocarbons are recovered each time step (c) is conducted. During step (c), it is preferred that all wells in fluid communication with the formation be shut in or recovering hydrocarbons. More preferably, all wells, e.g., production wells and injection wells, in fluid communication with the formation being treated are recovering hydrocarbons during step (c). In order to reduce the amount of gaseous carbon dioxide escaping from the formation during step (c), it is preferred that step (c) be carried out such that the average pressure in the formation is not substantially reduced relative to the average formation pressure prior to conducting step (a) for the first time. This preferred pressure constraint may be achieved by conducting step (c) for a relatively short time and/or maintaining a suitable back pressure on the wells. It is preferred that the formation not be depressured during steps (a), (b), (c) and (d) of the present process.

As noted above, during steps (a), (b) and (c) of the present process all wells in fluid communication with the formation function in the same manner, i.e., are used to inject carbon dioxide, are shut in or are used to recover hydrocarbons. However, with regard to steps (e) and (f), the injection well or wells are used in step (e) and the production well or wells are used in step (f). Steps (e) and (f) preferably occur substantially simultaneously.

After steps (a), (b) and (c) have been repeated the desired number of times, step (e) is initiated. At least partially carbonated aqueous liquid composition is injected into the formation through at least one injection well, preferably all injection wells, in fluid communication with the formation. This composition is injected in an amount effective to drive at least a portion of said hydrocarbons in the formation toward the production well or wells. The amount (volume) of aqueous composition employed may vary widely and is preferably greater than the amount (volume at formation conditions) of carbon dioxide injected into the formation during any individual step (a). Only a portion, preferably the portion initially injected into the formation, of the aqueous composition need be carbonated. However, it is preferred that a major portion by weight, more preferably substantially all, of the aqueous composition be carbonated, i.e., be at least 50% saturated with carbon dioxide at formation conditions.

In addition, the at least partially carbonated aqueous liquid composition preferably acts to transport carbon dioxide to regions of the formation previously, i.e., during steps (a), (b) and (c), uncontacted with carbon dioxide, thus still further enhancing the recovery of hydrocarbons from the formation. The use of a carbonated drive fluid, i.e., the present aqueous composition, performs effectively as a drive fluid and also reduces the amount of carbon dioxide stripped from the hydrocarbons during step (e).

Advantageously, the aqueous composition comprises water, at least 0.15 of a formation pore volume of which is carbonated to a minimum of 50 percent saturation with carbon dioxide, is employed. In some instances it may be desirable to add a viscosity-increasing agent to at least part of the driving fluid to thereby adjust the viscosity so as to be of the order of or greater than that of hydrocarbons to be recovered. Conventional surface active agents and emulsifiers can also be employed. At all times when the aqueous driving fluid is being injected into the formation, the formation at the production well or wells is maintained preferably at a pressure of the same order of magnitude as at the injection well or wells but sufficiently below the injection pressure so as to permit hydrocarbons to flow through the formation.

In employing the process of this invention in the exploitation of a petroleum-bearing formation, conventional production equipment is utilized. Because the system requires the injection of fluids into a subterranean geological petroleum-bearing formation, it is necessary that a combination of injection and production wells be employed. The injected fluids, including the carbon dioxide and carbonated aqueous composition, are introduced into the injection well or wells in a conventional manner. Because the particular practices and techniques employed for injection of gaseous and/or liquid fluids into a formation are within the skill of one working in the art, and outside the scope of this invention, the mechanical equipment necessary for the introduction of the injection fluid and/or gases of this invention is left to the choice of such worker.

The following, non-limiting example illustrates certain aspects of the present invention.

EXAMPLE

A crude petroleum-bearing formation is selected for treating. The live oil viscosity of the crude petroleum in this formation is about 180cp. The formation average temperature and pressure are about 150 degrees F. and 500 psi, respectively.

Five wells in the conventional spot pattern are drilled into the formation so that each of the five wells is in fluid communication with the formation. Conditions are such that conventional primary recovery techniques are not effective to recover crude petroleum from the formation.

Each of the five wells is used to inject 1% by volume (based on formation conditions) of the total pore space of the formation of gaseous carbon dioxide into the formation. After this injection, all the five wells are shut in for one week. After this time, each of the five wells is used to recover crude petroleum from the formation for a one month period. Back pressure is applied to the wells so that the average formation pressure is maintained above 500 psi.

This injection/shutting in/recovery cycle is repeated three times.

After the last recovery step, carbonated water (80% saturated with carbon dioxide at formation conditions) is injected into the formation from each of the four outlying wells. Crude petroleum is recovered from the formation through the centrally located well. A substantial amount of crude petroleum is effectively and economically recovered using the operation described above.

While the invention has been described with respect to various specific examples and embodiments, it is to be understood that the invention is not limited thereto and that it can be variously practiced within the scope of the following claims.

The embodiments of the present invention in which an exclusive property or privilege is claimed are as follows:

1. A process for recovering hydrocarbons from a hydrocarbon-bearing porous formation through at least one production means in fluid communication with said formation comprising:

(a) injecting carbon dioxide into said formation;

(b) shutting in said formation for a period of time sufficient to allow at least a portion of said injected carbon dioxide to contact and become dispersed in said hydrocarbons in said formation;

(c) recovering hydrocarbons from said formation without reducing the average pressure in said formation substantially relative to the average pressure in said formation prior to conducting step (a);

(d) repeating steps (a), (b) and (c) at least once;

(e) injecting an aqueous liquid compositions into said formation through at least one injection means in fluid communication with said formation, said liquid composition being saturated with carbon dioxide to the extent that the carbon dioxide dispersed in said hydrocarbons and in the reservoir pore space created by step (c) is substantially precluded from being stripped from said hydrocarbons upon contact with said liquid composition and said liquid composition being injected in an amount effective to drive at least a portion of said hydrocarbons in said formation toward said production means; and (f) recovering said hydrocarbons from said formation through said productions means.

2. The process of claim 1 wherein said hydrocarbons comprise crude petroleum.

3. The process of claim 2 wherein step (d) comprises repeating steps (a), (b) and (c) in the range of 1 to about 6 times.

4. The process of claim 2 wherein step (d) comprises repeating steps (a), (b) and (c) in the range of 2 to about 4 times.

5. The process of claim 2 wherein said aqueous liquid composition is at least about 50% saturated with carbon dioxide.

6. The process of claim 2 wherein said aqueous, liquid composition comprises water and carbon dioxide dissolved therein.

7. The process of claim 2 wherein substantially no hydrocarbons are recovered from said formation during steps (a) and (b).

8. The process of claim 2 wherein all wells in fluid communication with said formation are shut in or injecting carbon dioxide into said formation during step (a).

9. The process of claim 8 wherein all wells in fluid communication with said formation are shut in or recovering said crude petroleum during step (c).

10. The process of claim 2 wherein all wells in fluid communication with said formation are injecting carbon dioxide into said formation during step (a).

11. The process of claim 10 wherein all wells in fluid communication with said formation are shut in or recovering said crude petroleum during step (c).

12. The process of claim 1 wherein step (d) comprises repeating steps (a), (b) and (c) in the range of 1 to about 6 times.

13. The process of claim 1 wherein step (d) comprises repeating steps (a), (b) and (c) in the range of about 2 to about 4 times.

14. The process of claim 1 wherein said aqueous liquid composition is at least about 50% saturated with carbon dioxide.

15. The process of claim 1 wherein said aqueous, liquid composition comprises water and carbon dioxide dissolved therein.

16. The process of claim 1 wherein substantially no hydrocarbons are recovered from said formation during steps (a) and (b).

17. The process of claim 1 wherein step (a) is repeated after step (d) and before step (e).

18. The process of claim 17 wherein during step (e) back pressure is maintained on said production means until the void space created in the formation during step (d) and (a) is substantially occupied by the aqueous liquid composition injected in step (e).

19. The process of claim 1 wherein during step (e) back pressure is maintained on said production means until the void space created in the formation during step (d) is substantially occupied by aqueous liquid composition injected in step (e).

20. A process for recovering hydrocarbons from a hydrocarbon-bearing porous formation through at least one production means in fluid communication with said formation comprising:

(a) injecting carbon dioxide into said formation;

(b) shutting in said formation for a period of time sufficient to allow at least a portion of said injected carbon dioxide to contact and become dispersed in said hydrocarbons in said formation;

(c) recovering hydrocarbons from said formation;

(d) repeating steps (a), (b) and (c) at least once;

(e) injecting an at least partially carbonated aqueous liquid composition into said formation through at least one injection means in fluid communication with said formation in an amount effective to drive at least a portion of aid hydrocarbons in said formation toward said production means while maintaining a back pressure on the production means until the void space created in said formation during step (d) is substantially occupied by the aqueous liquid composition being injected; and (f) recovering said hydrocarbons from said formation through said production means.

* * * * *